US005197822A

United States Patent [19]

Parks

[11] Patent Number: 5,197,822

[45] Date of Patent: Mar. 30, 1993

[54] EMPLACEMENT OF FORAMINOUS PIPING IN NON-COHESIVE SUBSOILS

[76] Inventor: James M. Parks, 3509 Merrick Ct., #210, Lexington, Ky. 40502

[21] Appl. No.: 610,906

[22] Filed: Nov. 9, 1990

[51] Int. Cl.[5] ..... E02B 3/02

[52] U.S. Cl. ..... 405/73; 405/74; 405/158

[58] Field of Search ..... 405/154, 158, 172, 248, 405/224, 226, 73, 74, 169, 228

[56] References Cited

U.S. PATENT DOCUMENTS

| | | | |
|---|---|---|---|
| 510,713 | 12/1893 | Scott | 405/73 X |
| 3,021,909 | 2/1962 | Postlewaite | 405/172 X |
| 3,173,271 | 3/1965 | Wittgenstein | 405/172 |
| 3,289,421 | 12/1966 | Hindman | 405/248 X |
| 3,447,330 | 6/1969 | Wyllie | 405/172 |
| 4,318,641 | 3/1982 | Hogervorst | 405/224 |
| 4,338,045 | 7/1982 | Cour | 405/172 |
| 4,352,595 | 10/1982 | Scodino | 405/158 |
| 4,389,034 | 6/1983 | Suttles | 405/172 X |
| 4,576,521 | 3/1986 | Conrad | 405/248 X |
| 4,615,646 | 10/1986 | Langner | 405/169 |

*Primary Examiner*—David H. Corbin
*Attorney, Agent, or Firm*—Charles A. McClure

[57] ABSTRACT

Horizontal foraminous piping is placed in non-cohesive subsoil by means of an upright engaged disengageably at its bottom end to the top end of an open-ended hollow upright stanchion. Fluid jetted into the top end of the placement pipe and out of the bottom end of the stanchion to fluidize subjacent subsoil enables the pipe to be pressed downward until the stanchion reaches a desired depth. With an end of the cable attached thereto, winding up of the cable draws the foraminous piping to the stanchion, while fluid jetted from the horizontal foraminous piping downward onto and into subjacent subsoil to fluidize it enables the piping to move down into and laterally within the subsoil, for attachment to the stanchion. The placement pipe is disengaged and removed—but may be reattached to facilitate subsequent removal of the stanchion and the piping, usually with fluidizing flow from the piping into adjacent subsoil.

11 Claims, 2 Drawing Sheets

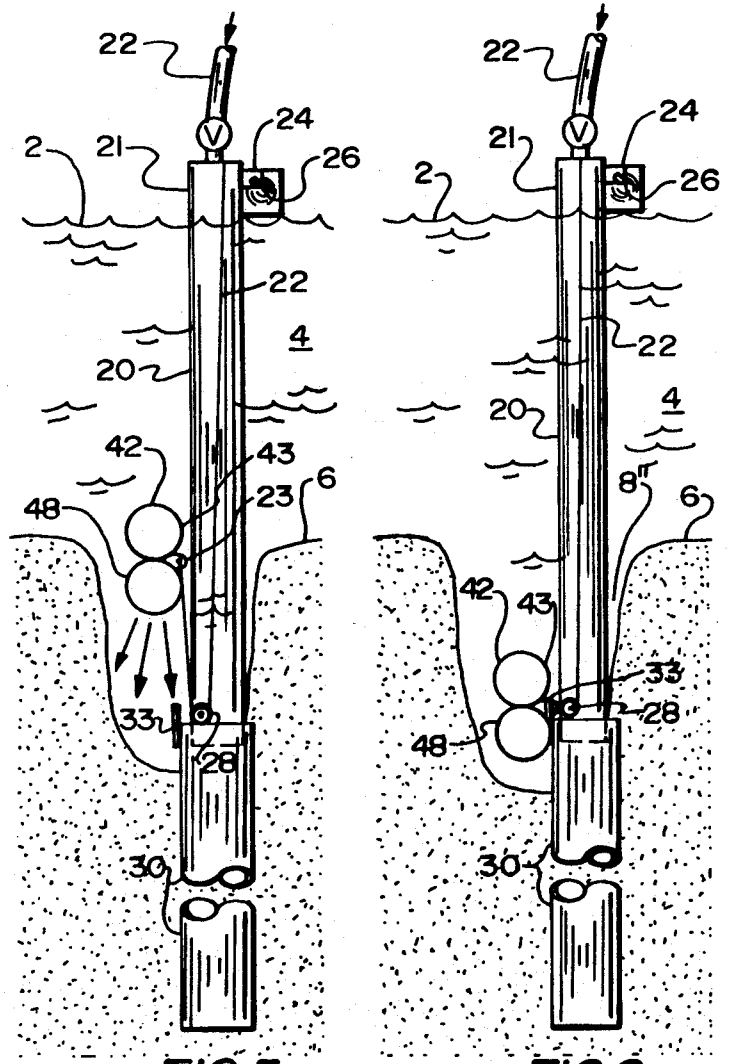
FIG. 5
FIG. 6
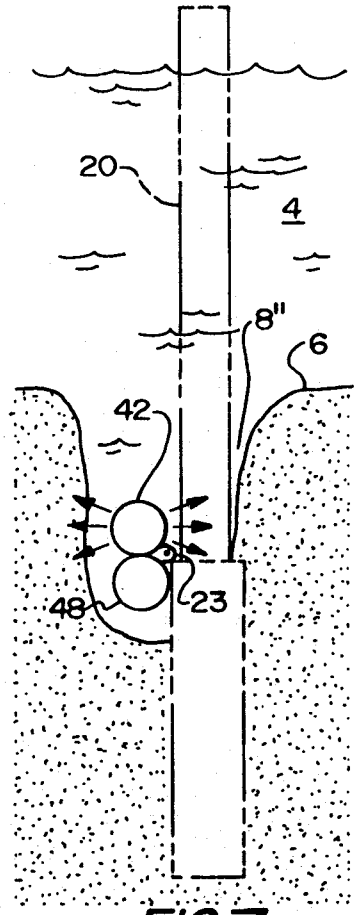
FIG. 7
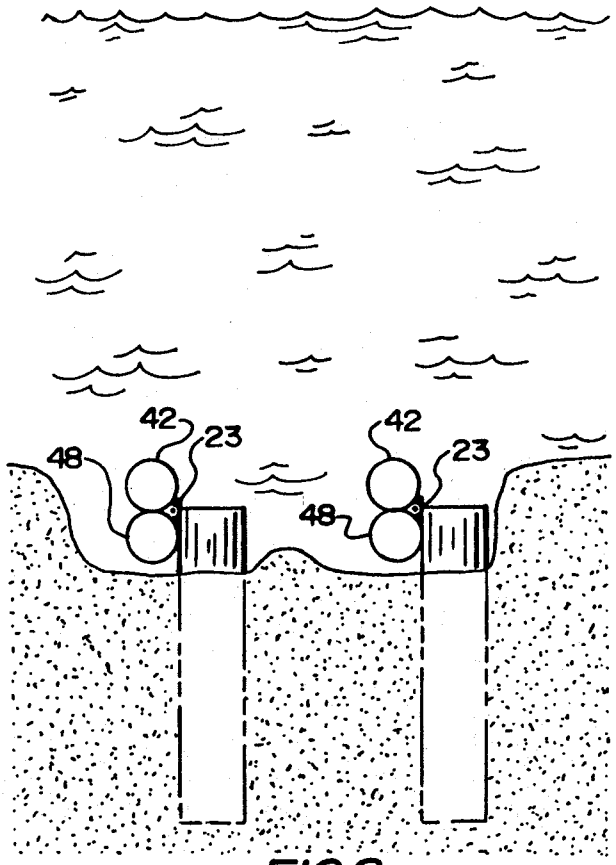
FIG. 8

EMPLACEMENT OF FORAMINOUS PIPING IN NON-COHESIVE SUBSOILS

TECHNICAL FIELD

This invention relates to emplacement of foraminous piping in non-cohesive subsoils, as for fluidization or stabilization thereof, with improved ways and means for burying retaining means therein.

BACKGROUND OF THE INVENTION

Numerous methods have been suggested and many have been used in an effort to control erosion, and to encourage accretion, of sand and other subsoils non-cohesive when wet, especially in the instance of beaches—and to discourage deposition of (or to displace) undesired sand or soil, especially in channels useful for shipping. Attempts to overcome undesired effects of wave action have usually been unavailing in the long run, sometimes producing the opposite of what was sought and/or other deleterious results. Man has to learn to use nature rather than to fight it in such environmental efforts.

Channel maintenance (or creation) traditionally is accomplished by dredging, repeated whenever current or wave action tends to fill in the channel (frequently). Dredging costs enough the first time, and necessary repetition is an aggravation of expense. Fluidization as an alternative to dredging is also well recognized, noted as long as a century ago by Scott in U.S. Pat. No. 510,713.

However, even such alternative channel clearing and maintenance have relied upon the energy-intensive step of dredging to enable the necessary piping to be buried preparatory to fluidizing use.

The piping placement art is represented by van Steveninck U.S. Pat. No. 3,695,049, in which piping to be buried is supplied with one or more small accompanying pipes to fluidize underlying subsoil "causing the pipeline together with the fluidization pipes to sink into the fluidized seabed." The present inventor has proposed aids to placement of fluidizing piping in his U.S. patent application Ser. No. 465,838 filed Jan. 16, 1990, now U.S. Pat. No. 5,052,857 and has cited additional prior art therein.

The present invention provides improved means and methods for emplacing foraminous piping and means for retaining such piping in place, as for use in non-cohesive soil fluidization for channel maintenance, or use in subsoil stabilization for beach maintenance.

SUMMARY OF THE INVENTION

A primary object of this invention is to provide a method of placing foraminous pipe for fluidization and/or stabilization usage.

Another object of the invention is to provide foraminous piping with associated installation means and methods.

A further object is to provide means for emplacing foraminous and to leave a minimum of such means in place along with the piping, and to remove the rest for use in other installations.

In general, the objects of the invention are accomplished by aiding placement of foraminous piping along a given route in subsoil adapted to become non-cohesive when fluidized--often underwater.

First, upright open-ended stanchions are placed along the route by jetting water or other fluid medium (e.g., air/water mixture) down from an upright placement pipe into, through, and out the bottom of each stanchion to fluidize subjacent subsoil, enabling the placement pipe and the stanchion to be pressed downward until the stanchion reaches a desired depth, usually at least partly buried in the surrounding subsoil, which settles around it after discontinuation of the jetting. A cable extending lengthwise of the placement pipe (inside it) and also to the exterior at its opposite ends is withdrawn outside at the bottom end sufficiently to be attached temporarily to the foraminous piping, and then is wound up to pull the foraminous piping to the stanchion. The piping is attached to the stanchion by any suitable means, after which the cable is detached and the placement pipe is disengaged from the stanchion and removed.

Apparatus for practicing the foregoing method to accomplish the foregoing objects comprises foraminous piping, a plurality of stanchions, a placement pipe removably engageable with individual stanchions adapted to receive a fluid medium jettable from the bottom thereof into it and any engaged stanchion—plus the foraminous piping. Preferably the placement pipe contains a cable extending lengthwise inside it and sidewise to the exterior at its opposite ends, so as to be unwound at the bottom end for attachment to the foraminous piping, then be wound up to draw the piping toward the stanchion, for attachment thereto, whereupon the cable is detached.

Other objects of this invention, together with means and methods for attaining the various objects, will be apparent from the following description and the accompanying diagrams of diverse embodiments, all presented by way of example rather than limitation.

SUMMARY OF THE DRAWINGS

FIG. 5 is a view similar to FIG. 4 with the fluidizing piping being lowered into the subsoil by reason of downward fluid jetting from the piping into the subsoil plus retracting of the cable;

FIG. 6 is a similar view showing the fluidizing piping at rest attached to the stanchion;

FIG. 7 is a view similar to FIG. 6 without the placement pipe and with fluid jetting sidewise into the subsoil and adjacent water;

FIG. 8 is a somewhat similar view showing a pair of adjacent stanchions flanking the route and with fluidizing piping in place for each stanchion so as to make a wider depression in the subsoil.

DESCRIPTION OF THE INVENTION

Figure 1:
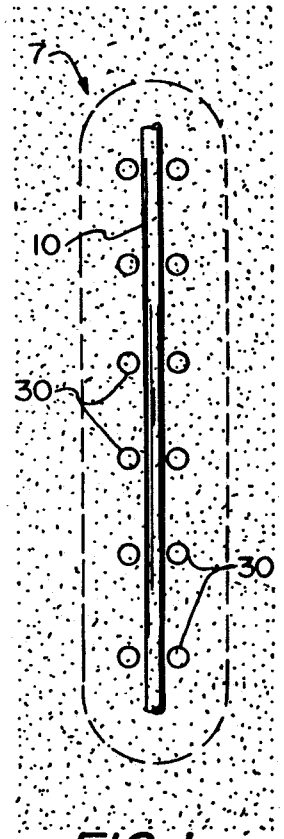
FIG. 1 is a plan view of a route along which foraminous piping is to be emplaced, showing stanchion locations spaced therealong.

FIG. 1 shows in plan inlet region 7 (broken lines) to be fluidized. Flanking piping route 10, dual rows of anchor means 30 are tangential to the route and spaced at alternating intervals.

FIGS. 2 to 8 are sequential views in the practice of this invention, as is apparent from them and the following description.

Figure 2:
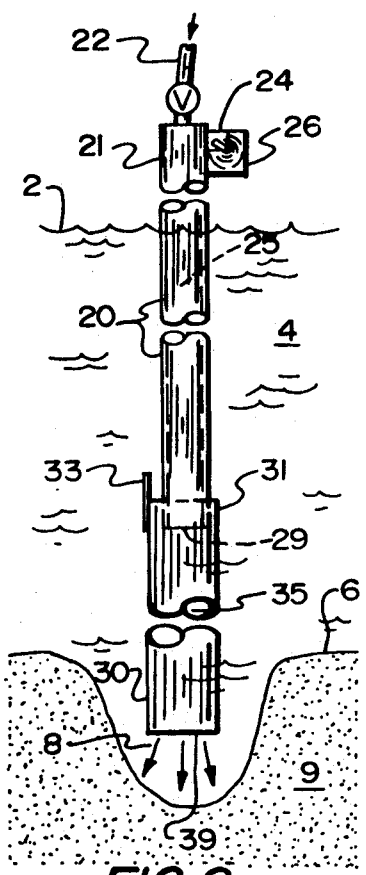
FIG. 2 is a side elevation of an upright open-ended stanchion engaged endwise by an overlying vertical placement pipe, partly cut away, lowering the stanchion into non-cohesive subsoil.

FIG. 2 shows in elevation surface 2 of body of water 4 overlying surface 6 of subsoil 9 with depression 8 therein, and features emplacement apparatus including upright placement pipe 20 with its top above the water surface, and upright stanchion 30 as potential anchor means connected to the pipe and above the subsoil depression, both moving downward (arrow). Bottom end 29 of the pipe is snugly engaged with top end 31 of the stanchion. Intermediate portions of both the placement pipe and the stanchion are omitted between their respective ends (bringing the top of the pipe too close to the water surface) to conserve drawing space. End-to-end bore 25 of the placement pipe and end-to-end bore 35 of the stanchion are aligned with and open to each other. Fluid supply tubing 22 (with arrow into it) has valve V in it and is attached to top end 21 of the placement pipe. Arrows from bottom end 39 of the stanchion downward into depression 8 signify a fluidizing flow out from bore 35 into the subsoil below. An arrow downward alongside the placement pipe shows that the entire assembly is being lowered. Housing 24 with winding handle 26 is affixed at the top of the pipe to carry a cable-storage drum (inside), and prong 33 extends upright at a side edge of the top of the stanchion—for purposes illustrated in subsequent views.

Figure 3:
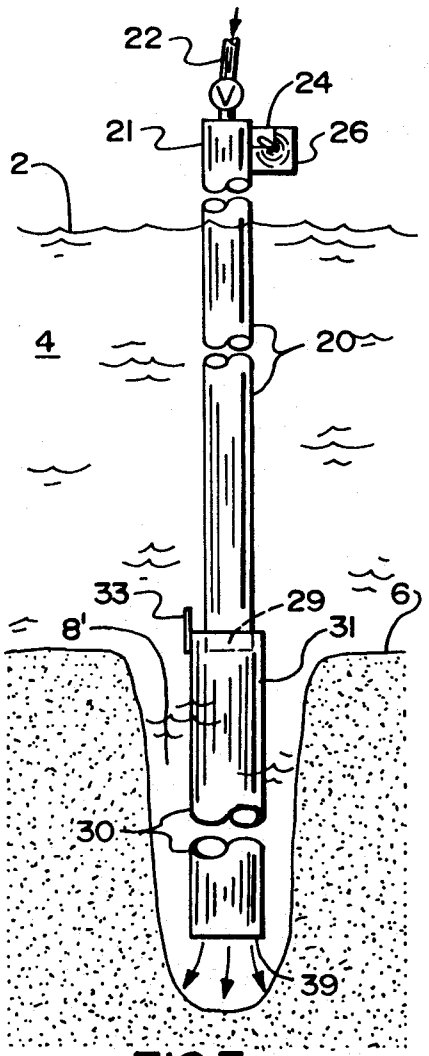
FIG. 3 is a similar view of the same with the stanchion lower in the subsoil and being lowered further thereinto.

FIG. 3 shows the same emplacement apparatus similarly but at a greater depth of insertion of the stanchion into the subsoil. Here the junction of pipe bottom end 29 and stanchion top end 31 is at the undisturbed subsoil level. The entire assembly is still being lowered (arrow alongside) to a greater depth of insertion of the stanchion—and part of the pipe—thereinto, and fluid is still flowing from the supply tube into the top end of the pipe and out the bottom end of the stanchion to fluidize the soil. Hence, the subsoil depression (redesignated 8') is deeper than before. At such level in this view is upright prong 33 affixed to one side of the stanchion top—for a purpose that will become more readily apparent in the next view.

Figure 4:
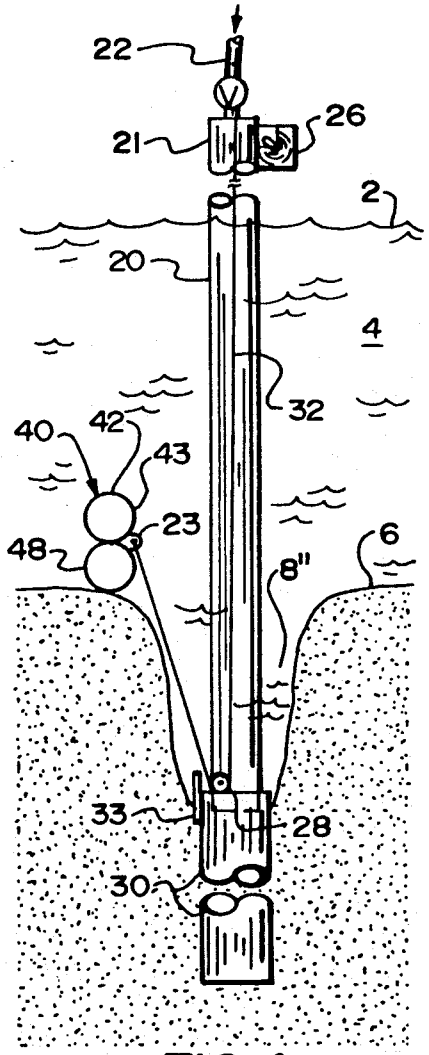
FIG. 4 is a similar view of the same with the stanchion at rest in the subsoil and with fluidizing piping at rest nearby and connected to a cable extending from the lower end of the placement pipe.

FIG. 4 shows the same emplacement apparatus at rest, with the stanchion buried and with the subsoil having filled back partially into the formerly fluidized opening (now redesignated 8''). Cable 22 unwound from the drum (not visible) in housing 24 enters the placement pipe sidewise through an opening (not visible) at or near the top of the pipe and runs down the length of the pipe to and partly around roller 28 and sidewise through an opening at or near the bottom of the pipe. Foraminous piping assembly 40 rests on the undisturbed subsoil surface with the free end of the cable temporarily secured to an opening in flange 43 joining upper (working) foraminous pipe 42 and lower (installation) foraminous pipe 48.

FIG. 5 shows the same emplacement apparatus with cable 32 being wound up (curved arrow at handle 26 and straight arrow alongside the cable inside placement pipe 20) and drawing foraminous piping assembly 40 down into the opening alongside the now stationary stanchion. Installation (lower) pipe 48 thereof is jetting water downward to fluidize the subsoil into which the assembly is moving.

FIG. 6 shows the same emplacement apparatus with foraminous piping assembly 40 in place with the opening in flange 43 thereof to which the cable had been temporarily fastened now fitting onto prong 33 at the top end of the stanchion. The cable is now at rest, wound up to keep it taut from top to bottom sidewise openings (no arrow). Working (upper) pipe 42 of the foraminous assembly is jetting fluid laterally (arrows) to fluidize the adjacent subsoil. The placement pipe has been removed for possible use elsewhere.

FIG. 8 shows similarly a stanchion and an attached foraminous piping assembly in each of dual rows of anchor means. Depressions produced in the subsoil by the respective assemblies have merged into a broad expanse designated 7, corresponding in width and depth (and length) to the desired inlet region 7 shown in plan in FIG. 1.

The sequence of steps in practicing this invention is apparent from the foregoing description of sequential stages in the process, which may be considered to include two successive method sequences: first, emplacing anchoring means; then emplacing foraminous piping means—followed by actual anti-shoaling working of the latter means.

The first emplacement conveniently comprises the sequential steps of removably engaging the lower end of a placement pipe, having a cable extending sidewise therethrough to the exterior at both of its ends, to the upper end of an open-ended stanchion, and orienting the engaged placement pipe and stanchion upright with the bottom end of the stanchion on such non-cohesive subsoil; jetting fluid into the top end of the placement pipe, through such pipe and the engaged stanchion and out of the bottom end of the upright stanchion into the subsoil so as to fluidize such subsoil, pressing the placement pipe down into the fluidized subsoil until the stanchion reaches a desired buried depth, and discontinuing jetting the fluid through the engaged placement pipe and stanchion.

The second emplacement conveniently comprises the sequential steps of unwinding the lower end of the cable, outside of the placement pipe, and attaching such cable removably to the foraminous piping; jetting a fluid medium from the foraminous piping downward onto and into such subsoil so as to fluidize such subsoil, winding up the cable and thereby drawing the foraminous piping to the stanchion, and attaching the foraminous piping to the stanchion; and discontinuing such jetting of water from the foraminous piping, disconnecting the cable end from the foraminous piping, and finally disengaging the pipe from the stanchion, leaving the foraminous piping attached to the stanchion at desired depth in the subsoil.

The working of the foraminous piping conveniently comprises the steps of jetting fluid laterally therefrom at intervals sufficiently frequent and forceful to fluidize the subsoil in the vicinity to prevent shoals from forming along the route. It will be understood that the piping is connected to a source of fluid, usually water but optionally mixed with air or sometimes even entirely air, under such pressure as to jet it vigorously enough to fluidize the subsoil. In many instances, such fluidization can be timed to take advantage of natural currents to remove the fluidized subsoil to a preferred location. Otherwise, the fluidized subsoil can be removed by eduction means, including flexible tubing moved along the route on a barge or otherwise and deposited on such a barge or more directly through the eduction means into a longshore current or even onto a nearby beach.

Although over-and-under foraminous piping has been illustrated and described, including a lower installation pipe (adapted to jet fluid downward) and an upper working pipe adapted to jet fluid laterally or sidewise, a side-by-side foraminous piping arrangement may be substituted wherein the pipes are adapted to jet fluid down and laterally apart with or without adjustable control of direction.

Although the stanchions have been shown smooth-sided, a circumferentially ribbed or otherwise roughened surface may be sustituted to enhance their anchoring. For example, a rib with a semi-conical downward tapering cross-section is more conducive to insertion than to removal. However, it should be noted that removal can be readily accomplished by reconnecting the placement pipe and forcing fluid down through the pipe and out the bottom of the connected stanchion, thereby fluidizing the surrounding subsoil, then lifting both. The foraminous piping assembly may be removed beforehand or concurrently by fluidizing the installation pipe and optionally the working pipe, and lifting the foraminous piping assembly (separately or together).

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. Apparatus for placement of foraminous piping along a route in subsoil adapted to become non-cohesive when fluidized, comprising a plurality of open-ended tubular stanchions adapted for use as underwater earth anchors and having lateral piping-attachment means, a placement pipe removably engageable at its lower end with the upper end of any stanchion while leaving a sidewise opening thereat, water-supplying means removably engageable with the upper end of such placement pipe while leaving a sidewise opening thereat, a cable extending lengthwise through such placement pipe and sidewise through such openings to the exterior and being removably attachable at its lower end to the foraminous piping outside, and winding means nearer the upper end of such placement pipe and adapted to unwind the cable for attachment to the foraminous piping and to wind the cable to pull such foraminous piping to a stanchion so engaged by the placement pipe for attachment to such stanchion.

2. Piping placement apparatus according to claim 1, wherein such piping includes a pair of foraminous pipes, each with openings in the lower half of the periphery thereof to jet water therefrom.

3. Piping placement apparatus according to claim 1, wherein the bottom end of such a placement pipe is engageable with the top end of such a stanchion by a press fit of the pipe to the stanchion.

4. The apparatus combination of claim 1 including a plurality of such stanchions at least partially buried to a desired depth in such subsoil at spaced intervals along such route, and foraminous piping extending along the route, attached to and thereby retained in place by such stanchions, adapted to jet water thereinto and so fluidize subjacent and laterally adjacent subsoil.

5. Anti-shoaling apparatus along a waterway route underlain by subsoil adapted to become non-cohesive when fluidized, comprising a placement pipe removably engageable at its lower end with the upper end of an upright open-ended tubular stanchion, and adapted to receive water into its top end and to discharge such water from its bottom end into the top end of such a stanchion when so engaged;

a cable extending lengthwise through such placement pipe and sidewise to the exterior in the vicinity of each end thereof;

cable-winding means adapted to wind and to unwind such cable a plurality of such stanchions at least partially buried to a desired depth in such subsoil at spaced intervals along such route, foraminous piping extending along the route, attached to and thereby retained in place by such stanchions, adapted to jet water thereinto and so fluidize subjacent and laterally adjacent subsoil.

6. Anti-shoaling apparatus, along a waterway route underlain by subsoil adapted to become non-cohesive when fluidized, including a plurality of open-ended tubular stanchions useful when at least partially buried upright in such subsoil as earth anchors;

each such stanchion being adapted to receive the bottom end of a placement pipe into engagement within its top end and also to receive water therefrom into its top end and to discharge such water from its bottom end into the subjacent soil so as to fluidize it and thereby enable each such stanchion to be lowered into such subsoil, foraminous piping extending along the route, attached to and thereby retained in place by such stanchions, adapted to jet water thereinto and so fluidize subjacent and laterally adjacent subsoil, a cable extending lengthwise through such placement pipe and sidewise to the exterior in the vicinity of each end thereof, being removably attachable to such foraminous piping; and cable-winding means adapted to unwind such cable to enable its attachment to such foraminous piping and further adapted to wind up such cable so as to draw such foraminous piping to such stanchions for attachment thereto.

7. A method of emplacing foraminous piping along a desired route in subsoil adapted to become non-cohesive when fluidized, comprising the steps of removably engaging the lower end of a placement pipe, having a cable extending sidewise therethrough to the exterior at both of its ends, to the upper end of an open-ended stanchion, and orienting the engaged placement pipe and stanchion upright with the bottom end of the stanchion on such non-cohesive subsoil;

unwinding the lower end of the cable, outside of the placement pipe, and attaching such cable removably to the foraminous piping;

jetting fluid into the top end of the placement pipe, through such pipe and the engaged stanchion and out of the bottom end of the upright stanchion into the subsoil so as to fluidize such subsoil, pressing the placement pipe down toward the fluidized subsoil until the stanchion reaches a desired buried depth, and discontinuing jetting the fluid through the engaged pipe and stanchion;

jetting a fluid medium from the foraminous piping downward onto and into such subsoil so as to fluidize such subsoil, winding up the cable and thereby drawing the foraminous piping to the stanchion, and attaching the foraminous piping to the stanchion; and discontinuing such jetting of water from the foraminous piping, disconnecting the cable end from the foraminous piping, and finally disengaging the pipe from the stanchion, leaving the foraminous piping attached to the stanchion at desired depth in the subsoil.

8. Anti-shoaling apparatus comprising a plurality of earth anchors in the form of upright stanchions buried to desired depth in non-cohesive subsoil along a desired route according to claim 7.

9. Anti-shoaling apparatus comprising foraminous piping emplaced along a desired route according to claim 7.

10. Anti-shoaling method, comprising jetting fluid downward from substantially horizontal foraminous piping into subjacent subsoil, so fluidizing the subsoil and so aiding burial of the piping therein and transport of the subsoil elsewhere by natural or man-made flow, including anchoring the foraminous fluidizing piping in place by connecting it disengageably to open-ended upright stanchions located at intervals along the route and buried in part at such locations by flowing fluid into the top of the stanchions and out the bottom of the stanchions into the subsoil and thus fluidizing it and removable later with aid of like fluidizing flow into surrounding subsoil.

11. Anti-shoaling apparatus along a waterway route underlain by subsoil adapted to become non-cohesive when fluidized, comprising substantially horizontal foraminous piping adapted to jet fluid down into subjacent subsoil to fluidize it and be buried along the route, and a plurality of upright stanchions at spaced intervals along such route adapted to jet fluid down into and thereby fluidize subjacent subsoil and be buried at least partly therein to desired depth, the foraminous piping and the stanchions being adapted to be connected disengageably together to anchor the piping to the stanchions.

* * * * *